US005692677A

United States Patent [19]

Duconseil

[11] Patent Number: 5,692,677

[45] Date of Patent: Dec. 2, 1997

[54] DEVICE FOR SUPPORTING AND SECURING A RAILWAY TRACK RAIL

[75] Inventor: René Duconseil, Hamel, France

[73] Assignee: Allevard, Saint Cloud, France

[21] Appl. No.: 535,063

[22] PCT Filed: May 10, 1994

[86] PCT No.: PCT/FR94/00553

§ 371 Date: Nov. 2, 1995

§ 102(e) Date: Nov. 2, 1995

[87] PCT Pub. No.: WO94/26977

PCT Pub. Date: Nov. 24, 1994

[30] Foreign Application Priority Data

May 10, 1993 [FR] France ..... 93 05601

[51] Int. Cl.[6] ..... E01B 9/68

[52] U.S. Cl. ..... 238/283; 238/107; 238/351

[58] Field of Search ..... 238/107, 283, 238/349, 351

[56] References Cited

U.S. PATENT DOCUMENTS

| | | | |
|---|---|---|---|
| 3,581,990 | 6/1971 | Kirik | 238/283 |
| 3,784,098 | 1/1974 | Serafin et al. | 238/283 |
| 4,216,904 | 8/1980 | Vivion | 238/25 |
| 4,648,554 | 3/1987 | McQueen | 238/283 |
| 4,771,944 | 9/1988 | Brister et al. | 238/283 |
| 5,016,816 | 5/1991 | Lanham | 238/351 |

FOREIGN PATENT DOCUMENTS

| | | |
|---|---|---|
| 0169685 | 1/1986 | European Pat. Off. . |
| 279094 | 8/1988 | European Pat. Off. . |
| 2359245 | 2/1978 | France . |
| 2354960 | 5/1975 | Germany . |
| 2051187 | 1/1981 | United Kingdom . |
| 9008224 | 7/1990 | WIPO . |

*Primary Examiner*—S. Joseph Morano
*Attorney, Agent, or Firm*—Dennison, Meserole, Pollack & Scheiner

[57] ABSTRACT

The invention relates to a device for supporting and wedging a railway rail (R) on a tie (T), the device comprising in particular a resilient pad (1) on which there rests the base (Ra) of the rail (R) and two insulating tabs (2, 2') interposed between the rail (R) and spring clips (A, A') which are fixed on inserts (I, I') secured laterally in the tie (T).

According to the invention, said pad (1) comprises a central portion (10) supporting the base (Ra) of the rail (R) and two symmetrical lateral portions (11, 11') of smaller thickness disposed beneath the bottom edges of the tabs (2, 2') which are themselves situated at a level lower than the base (Ra) of the rail (R).

10 Claims, 1 Drawing Sheet

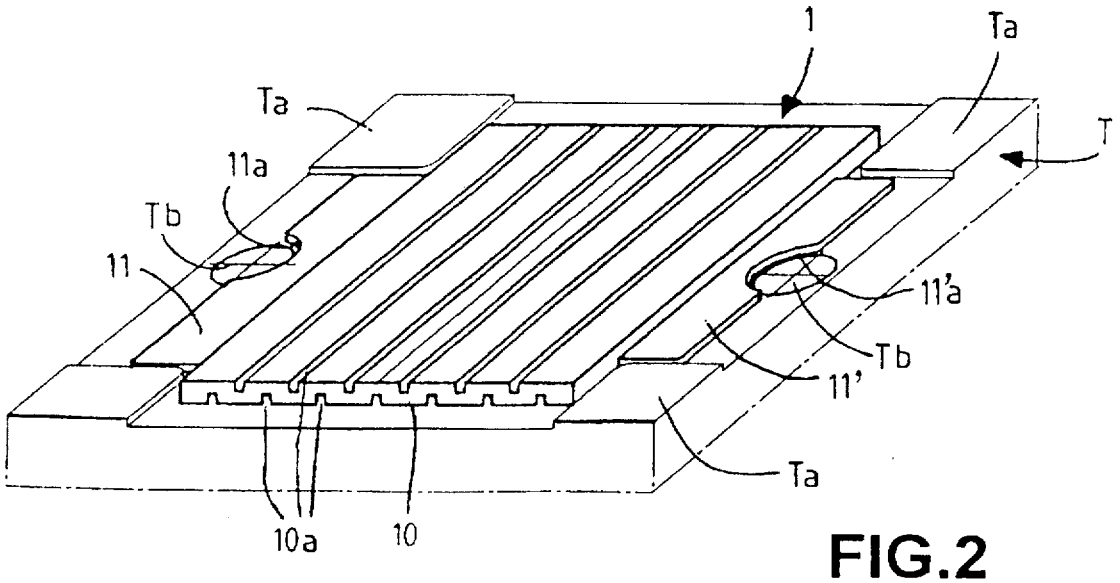
FIG.2
FIG.1
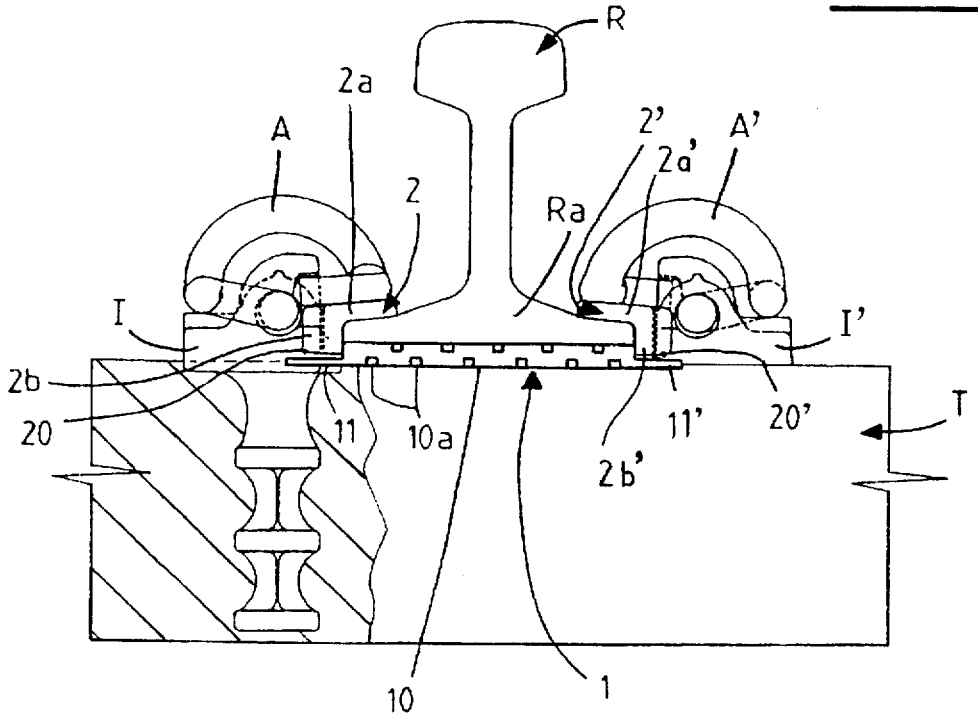

DEVICE FOR SUPPORTING AND SECURING A RAILWAY TRACK RAIL

BACKGROUND OF THE INVENTION

The present invention relates to a device for supporting and wedging a railway rail on a tie.

Devices of this type comprise, in particular, a resilient pad on which the base of the rail rests, and insulating tabs interposed between the rail and spring clips which are fixed on inserts secured laterally in the tie.

In such devices, the pad is generally of uniform thickness while the tabs bear against the flange of the rail without their bottom edges coming into contact with the pad.

In that configuration, the bottom edge of a tab remains at a level above the base of the rail. It frequently happens that during one of the stages of track-laying, it is necessary to lift up the rail and replace the pads under the rail at regular intervals with steel support rollers of a diameter greater than the thickness of the pad in order to provide the rail with a degree of freedom in translation. The purpose of this operation is to make stresses uniform over the entire rail.

Unfortunately it is very difficult to remove pads of uniform thickness because of their lack of flexibility.

In addition, the shape and the position of the tabs are unsuitable for obtaining good resistance to compression under the action of lateral forces generated by rolling stock and transmitted by the rail.

OBJECTS OF THE INVENTION

An object of the present invention is to solve those problems in satisfactory manner.

This object is achieved by means of a device in which the pad comprises a central portion supporting the base of the rail and two symmetrical lateral portions of smaller thickness disposed beneath the bottom edges of the tabs which are themselves situated at a level lower than the base of the rail.

SUMMARY OF THE INVENTION

According to an advantageous characteristic, there is clearance between the bottom edges of the tabs and the corresponding lateral portions of the pad.

According to another characteristic, the clearance between the bottom edges of the tabs and the lateral portions of the pad lies in the range 0.5 mm to 5 mm.

According to yet another characteristic, the difference in thickness between the central portion and the lateral portions of the pad is not less than 3 mm when the rail is in place, and in a variant embodiment, the thickness of the lateral portions of the pad is not greater than half the thickness of the central portion.

In a particular embodiment, the position of the bottom edge of each tab is situated at least 2 mm below the level of the base of the rail, and is preferably constituted by a substantially horizontal plane face.

According to other characteristics, for the purpose of wedging the pad, its lateral portions are engaged between corresponding shoulders formed on the top face of the tie.

In the latter variant, said lateral portions are of a length that is shorter than the length of the central portion.

In addition, said lateral portions of the pad are solid whereas the central portion includes hollowed-out zones.

The device of the invention makes it easy to remove the pad from its location beneath the length of rail by lifting the lateral portions through 90° and by exerting a traction force parallel to said length.

In the same manner, installing said pad is facilitated by the flexibility of the lateral portions.

The combination between the pad and the tabs as described above also makes it possible to obtain resistance to compression that is satisfactory insofar as the bottom face of the rail is situated above the bottom edges of the tabs, thereby enabling a better distribution of stresses in the tab and therefore better resistance than in the case of prior devices.

The present invention will be better understood on reading the following description accompanied by a drawing in which:

BRIEF DESCRIPTION OF THE DRAWINGS

FIG. 1 is a cross-section view through the device of the invention associated with the rail fixing system; and FIG. 2 is a perspective view of one embodiment of the pad of the invention.

DETAILED DESCRIPTION OF THE INVENTION

The device shown in FIG. 1 is designed to support and wedge a railway rail R on a tie T.

The device comprises a resilient pad 1 on which the base Ra of the rail R rests, together with two symmetrical insulating tabs 2, 2'.

The tabs 2, 2' are interposed between the rail R and the spring clips A, A' which are fixed on inserts I, I' in the tie, T.

The pad 1 is formed as a single piece comprising a central portion 10 that supports the base Ra of the rail R, together with two symmetrical lateral portions 11, 11' of smaller thickness to be disposed beneath the bottom edges 20, 20' of the tabs 2, 2' which edges are themselves situated at a level lower than the bottom face of the base Ra of the rail R.

Each of the tabs 2, 2' comprises portion 2*a*, 2*a'* which is disposed beneath one of the branches of the clip A, A' to bear against the flange of the rail R and which extends downwards, and a substantially vertical bottom portion 2*b*, 2*b'* which terminates in the bottom edge 20, 20'.

The inside faces of the tabs 2, 2' closely match the outside profile of the base of the bottom portion 2*b*, 2*b'* of the rail R both on their top portions 2*a*, 2*a'*, and on their bottom portions 2*b*, 2*b'*.

The bottom edge 20, 20' is implemented in the form of a substantially horizontal plane face.

In the assembled position, the rail R placed on the central portion 10 of the pad 1 compresses the pad a little under its own weight and also with the clamping force of the spring clips, however, in this rest position, there remains clearance between the bottom edges 20, 20' of the tabs 2, 2' and the top faces of the lateral portions 11, 11' of the pad 1.

When a greater compression force is applied, the thickness of the central portion 10 of the resilient pad 1 is diminished and the tabs move down by a corresponding amount; nevertheless, the clearance between the bottom edges 20, 20' of the tabs 2, 2' is such that under normal conditions, the bottom edges 20, 20' do not come into contact with the top faces of the corresponding lateral portions 11, 11'.

The clearance between the bottom edges 20, 20' of the tabs 2, 2' and the top faces of the lateral portions 11, 11' lies preferably in the range 0.5 mm to 5 mm.

Simultaneously, provision is made for the difference in thickness between the lateral portions 11, 11' of the pad 1 and the central portion 10 to be not less than 3 mm when the rail is placed on said central portion.

Under such conditions, the bottom edges 20, 20' of the tabs 2, 2' are situated at least 2 mm below the level of the base Ra of the rail R resting on the central portion 10.

The central portion 10 of the pad 1 includes hollowed-out zones 10*a* in the form of grooves or cells so as to possess a determined degree of compressibility.

In contrast, the lateral portions 11, 11' are solid since they serve as tab surfaces for the bottom edges 20, 20' of the tabs 2, 2' and must therefore be harder than the central portion 10.

FIG. 2 is a fragmentary perspective view of a particular embodiment of the pad 1.

The lateral portions 11, 11' of the pad 1 are shorter in length than the central portion 10.

The lateral portions 11, 11' are engaged between shoulders Ta formed on the top face of the tie T for the purpose of wedging said pad.

The outside edges of the lateral portions 11, 11' include cutouts 11*a*, 11*a'* for uncovering the orifices Tb in the tie T that are designed to receive the members for securing the inserts I, I'.

I claim:

1. A device for supporting and wedging a railway rail on a tie where the rail has a base portion which is secured to the tie with spring clips, a first spring clip end being fixed on inserts which are secured in the tie; insulating tabs interposed between a second spring clip end and the base portion of the rail, the insulating tabs having a substantially horizontal top portion and a vertical portion which terminates with a bottom edge, said device comprising: a pad formed as a single piece including a resilient center portion for placement between the rail base portion and the tie; and two symmetrical lateral portions, said lateral portions having a thickness which is smaller than the central portion; each of said lateral portions for being disposed beneath the bottom edge of an insulating tab so that a clearance exists between the bottom edge and the lateral portion.

2. A device according to claim 1, wherein the clearance between a bottom edge of the insulating tab and the lateral portion of the pad lies in the range 0.5 mm to 5 mm.

3. A device according to claim 2, wherein the difference in thickness between the central portion and the lateral portion of the pad is not less than 3 mm when a rail is placed on the pad.

4. A device according to claim 3, wherein the thickness of the lateral portions of the pad is less than half the thickness of the central portion.

5. A device according to claim 4, wherein the position of the bottom edge of the tab is situated at least 2 mm below the level of the base of the rail.

6. A device according to claim 1, wherein for the purpose of wedging the pad, its lateral portions are engaged between corresponding shoulders formed on the top face of a tie.

7. A device according to claim 6, wherein said lateral portions of the pad are solid and the central portion includes hollowed-out zones.

8. A device according to claim 1, wherein the lateral portions are shorter in length than the central portion.

9. A device according to claim 6, wherein the bottom edge of each tab forms a substantially horizontal plane face.

10. A device for supporting and wedging a railway rail on a tie where the rail has a base portion which is secured to the tie with spring clips, a first spring clip end being fixed on inserts which are secured in the tie; insulating tabs interposed between a second spring clip end and the base portion of the rail, the insulating tabs having a substantially horizontal top portion and a vertical portion terminating in a bottom edge, said device comprising: a pad formed as a single piece including a resilient center portion for placement between the rail base portion and the tie; and two symmetrical lateral portions, each lateral portion for being disposed beneath the bottom edge of an insulating tab; said lateral portions having a thickness which is smaller than the central portion, so that an upper surface of said lateral portions are located below the level of the base portion of the rail.

* * * * *